US008022972B2

(12) United States Patent
Hong et al.

(10) Patent No.: US 8,022,972 B2
(45) Date of Patent: Sep. 20, 2011

(54) AUTOMATIC COARSENESS SETTING METHOD IN VIDEO DISPLAY APPARATUS

(75) Inventors: Yun-ju Hong, Suwon-si (KR); Young-chan Kim, Uiwang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 849 days.

(21) Appl. No.: 12/027,340

(22) Filed: Feb. 7, 2008

(65) Prior Publication Data

US 2008/0297543 A1 Dec. 4, 2008

(30) Foreign Application Priority Data

May 31, 2007 (KR) ..... 10-2007-0053402

(51) Int. Cl.
*G09G 5/02* (2006.01)

(52) U.S. Cl. ..... 345/699; 345/698

(58) Field of Classification Search ..... 345/698, 345/699

See application file for complete search history.

(56) References Cited

U.S. PATENT DOCUMENTS

| | | | | |
|---|---|---|---|---|
| 6,043,803 | A | 3/2000 | Shimizu | |
| 6,348,931 | B1 * | 2/2002 | Suga et al. | 345/699 |
| 6,392,642 | B1 | 5/2002 | Wu | |

FOREIGN PATENT DOCUMENTS

WO 01/01386 A1 1/2001

* cited by examiner

*Primary Examiner* — Quan-Zhen Wang
*Assistant Examiner* — Troy Dalrymple
(74) *Attorney, Agent, or Firm* — Sughrue Mion, PLLC

(57) ABSTRACT

An automatic coarseness setting method in a video display apparatus is provided. According to the automatic coarseness setting method, when an automatic adjustment command is input or when a new mode video signal is received to the video display apparatus, a pixel clock of an input video signal is detected, and a coarseness value is automatically set based on the detected pixel clock. Accordingly, it is possible to provide optimum video display using a coarseness value most suitable for the input video signal.

4 Claims, 6 Drawing Sheets

AUTOMATIC COARSENESS SETTING METHOD IN VIDEO DISPLAY APPARATUS

CROSS-REFERENCE TO RELATED APPLICATIONS

This application claims priority from Korean Patent Application No. 10-2007-0053402, filed on May 31, 2007, in the Korean Intellectual Property Office, the disclosure of which is incorporated herein by reference in its entirety.

BACKGROUND OF THE INVENTION

1. Field of the Invention

Apparatuses and methods consistent with the present invention relate to automatically setting coarseness in a video display apparatus, and more particularly, to automatically setting coarseness in a video display apparatus when a video signal input from an external apparatus, such as a personal computer (PC), is displayed on a screen.

2. Description of the Related Art

FIG. 1 is a flowchart illustrating a related resolution setting method in a video display apparatus.

In FIG. 1, if a video signal is input from an external apparatus (S10), the video display apparatus may determine a resolution of the input video signal using a horizontal synchronizing signal (H Sync) and a vertical synchronizing signal (V Sync) of the input video signal (S11). The video display apparatus may also determine whether or not the resolution of the input video signal is equal to a preset resolution (S12). If it is determined that the resolution of the input video signal is equal to a preset resolution, the input video signal may be displayed on a screen based on the set resolution (S16).

If it is determined that the resolution of the input video signal is not equal to the preset resolution in operation S12, the video display apparatus may determine whether a resolution stored in the video display apparatus is equal to the resolution of the input video signal (S13). If it is determined that a resolution stored in the video display apparatus is equal to the resolution of the input video signal, the video display apparatus may convert the preset resolution into the resolution of the input video signal (S14), and may display the input video signal on the screen (S16).

Alternatively, if it is determined that a resolution stored in the video display apparatus differs from the resolution of the input video signal in operation S13, the video display apparatus may convert the present resolution into a resolution close to the resolution of the input video signal (S15), and may display the input video signal on the screen (S16). For example, if the input video signal has a resolution of 800*600 (62 Hz), and if a resolution of 800*600 (60 Hz) closest to the resolution is stored in the video display apparatus, the input video signal may be displayed on the screen at the resolution of 800*600 (60 Hz).

Accordingly, the horizontal (H) position, vertical (V) position and coarseness of the input video signal may deviate off the edge of the screen, and in the worst situation no video signal may be displayed on the screen. In order to solve the problems, the video display apparatus has an automatic setting function to automatically set the H position, V position and coarseness. When the automatic setting function is performed, the coarseness setting may differ according to the type of video signal.

FIGS. 2A and 2B are diagrams showing related video signals transmitted to the video display apparatus.

FIG. 2A is a normal timing diagram of an input video signal. The input video signal shown in FIG. 2A has 2240 pixel clocks for a single screen, and 1680 pixel clocks for an active area, in which video is currently displayed on the screen. Additionally, the H Sync of the input video signal has negative polarity, and the V Sync of the input video signal has positive polarity.

FIG. 2B is an offset timing diagram of an input video signal. Such an input video signal is generally used in a flat type video display apparatus. The input video signal shown in FIG. 2B has 1840 pixel clocks for a single screen and 1680 pixel clocks for an active area of the screen. The H Sync of the input video signal has positive polarity, and the V Sync of the input video signal has negative polarity.

The pixel clocks of the video display characteristics are used to convert a received analog video signal into a corresponding digital video signal, and are set as a coarseness value in the video display apparatus.

FIG. 3 is a flowchart illustrating an automatic coarseness setting method in a related video display apparatus.

In FIG. 3, if a user inputs an automatic adjustment command to the video display apparatus (S20), the video display apparatus may detect a pixel clock of the input video signal (S21), and may determine whether the pixel clock of the input video signal corresponds to a preset coarseness value (S23). If it is determined that the pixel clock of the input video signal differs from the preset coarseness value, the video display apparatus may determine whether the pixel clock of the input video signal is contained in a coarseness adjustment range (S25).

If it is determined that the pixel clock of the input video signal is contained in the coarseness adjustment range in operation S25, the preset coarseness value may be changed to a coarseness value corresponding to the pixel clock of the input video signal (S27). On the other hand, if it is determined that the pixel clock of the input video signal is not contained in a coarseness adjustment range in operation S25, the preset coarseness value may be changed to a default value (S29).

For example, assuming that the default value, minimum value and maximum value are set to 2240, 2160 and 2320, respectively, in a first coarseness adjustment range, if a coarseness value of 2150 is preset in the video display apparatus and if a pixel clock of an input video signal is set to 1900, the input video signal may be displayed on the screen at the default value of 2240 in the first coarseness adjustment range. Accordingly, a portion of the input video signal may deviate off the edge of the screen.

Alternatively, assuming that the default value, minimum value and maximum value are set to 1840, 1760 and 1920, respectively, in a second coarseness adjustment range, if a coarseness value of 1900 is preset in the video display apparatus and if a pixel clock of an input video signal is set to 2150, the input video signal may be displayed on the screen at the default value of 1840 in the second coarseness adjustment range. Accordingly, the input video signal may be displayed at a size smaller than the original size, without covering the entire screen.

If the input video signal is not in compliance with the Video Electronics Standards Association (VESA) standard, it is impossible to clearly distinguish whether an input video signal is applied with normal timing or with offset timing, so the above-described problems may be aggravated.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides an automatic coarseness setting method in a video display apparatus, in which when a video signal not in compliance with the Video Electronics Standards Association (VESA) standard is input, the coarseness value of the video signal is automatically set by shifting a coarseness range in order to display the video in an optimum state.

According to an aspect of the present invention, there is provided an automatic coarseness setting method in a video display apparatus, the method comprising detecting a pixel clock of an input video signal; and selecting one of a plurality of coarseness ranges and setting one value from among coarseness values within the selected coarseness range as a coarseness value to be used to display the input video signal on a screen, based on the pixel clock.

The setting may comprise determining whether the pixel clock of the input video signal is included in the selected coarseness range; and changing a preset coarseness value to a coarseness value corresponding to the pixel clock, if it is determined that the pixel clock is contained in the selected coarseness range.

The setting may comprise determining whether the pixel clock of the input video signal is included in the selected coarseness range; determining whether the selected coarseness range has been shifted, if it is determined that the pixel clock is not included in the selected coarseness range; and shifting the selected coarseness range, if it is determined that the selected coarseness range has not been shifted.

The automatic coarseness setting method may further comprise restoring the selected coarseness range to its original range if it is determined that the selected coarseness range has been shifted.

According to another aspect of the present invention, there is provided a video display apparatus comprising a detecting unit which detects a pixel clock of an input video signal; and a setting unit which selects one of a plurality of coarseness ranges and sets one value from among coarseness values within the selected coarseness range as a coarseness value to be used to display the input video signal on the screen, based on the pixel clock.

The setting unit may determine whether the pixel clock of the input video signal is included in the selected coarseness range, and may change a preset coarseness value to a coarseness value corresponding to the pixel clock if it is determined that the pixel clock is included in the selected coarseness range.

The setting unit may determine whether the pixel clock of the input video signal is included in the selected coarseness range, it may determine whether the selected coarseness range has been shifted if it is determined that the pixel clock is not included in the selected coarseness range, and it may shift the selected coarseness range if it is determined that the selected coarseness range has not been shifted.

The setting unit may also restore the selected coarseness range to its original range if it is determined that the selected coarseness range has been shifted.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF EXEMPLARY EMBODIMENTS

Figure 1:
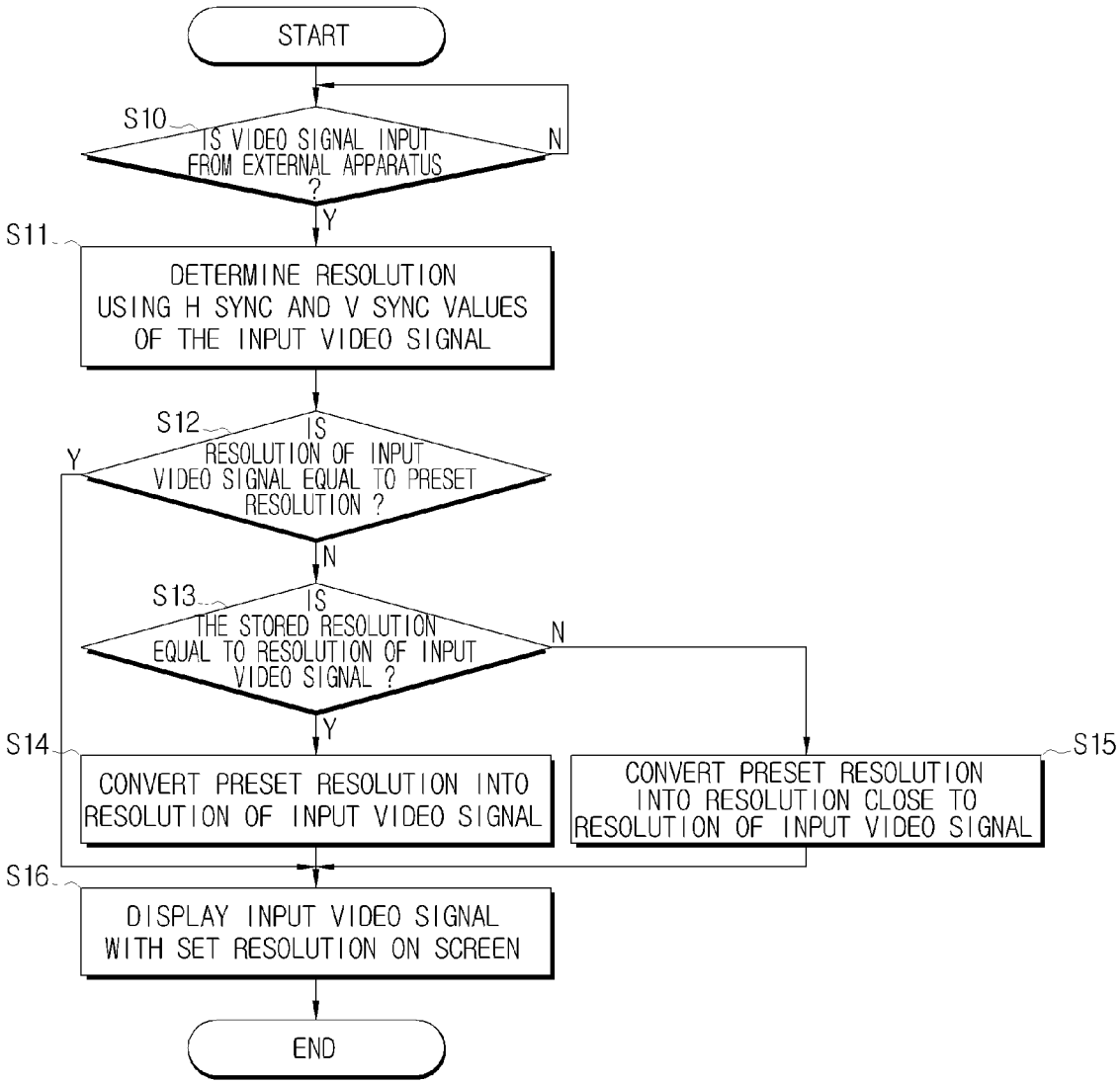
FIG. 1 (RELATED ART)
FIG. 1 is a flowchart explaining a related resolution setting method in a video display apparatus.
Figure 2A:
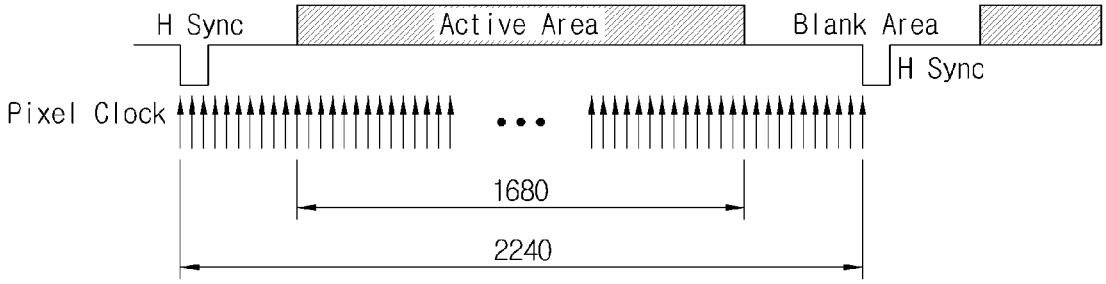
FIG. 2A (RELATED ART)
FIGS. 2A and 2B are diagrams showing related video signals transmitted to a video display apparatus.
Figure 2B:
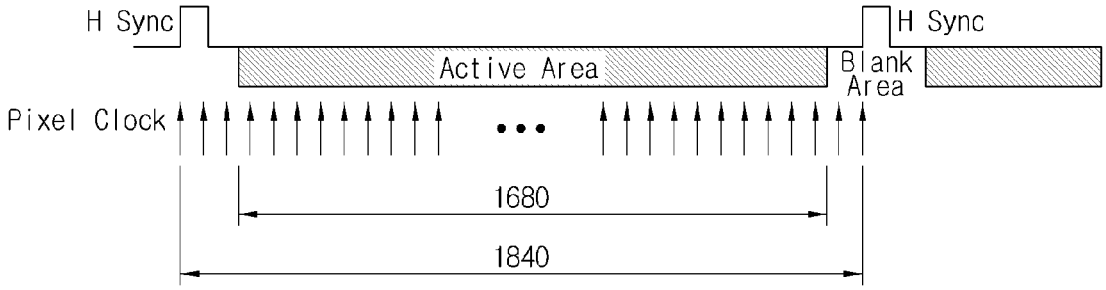
FIG. 2B (RELATED ART)
Figure 3:
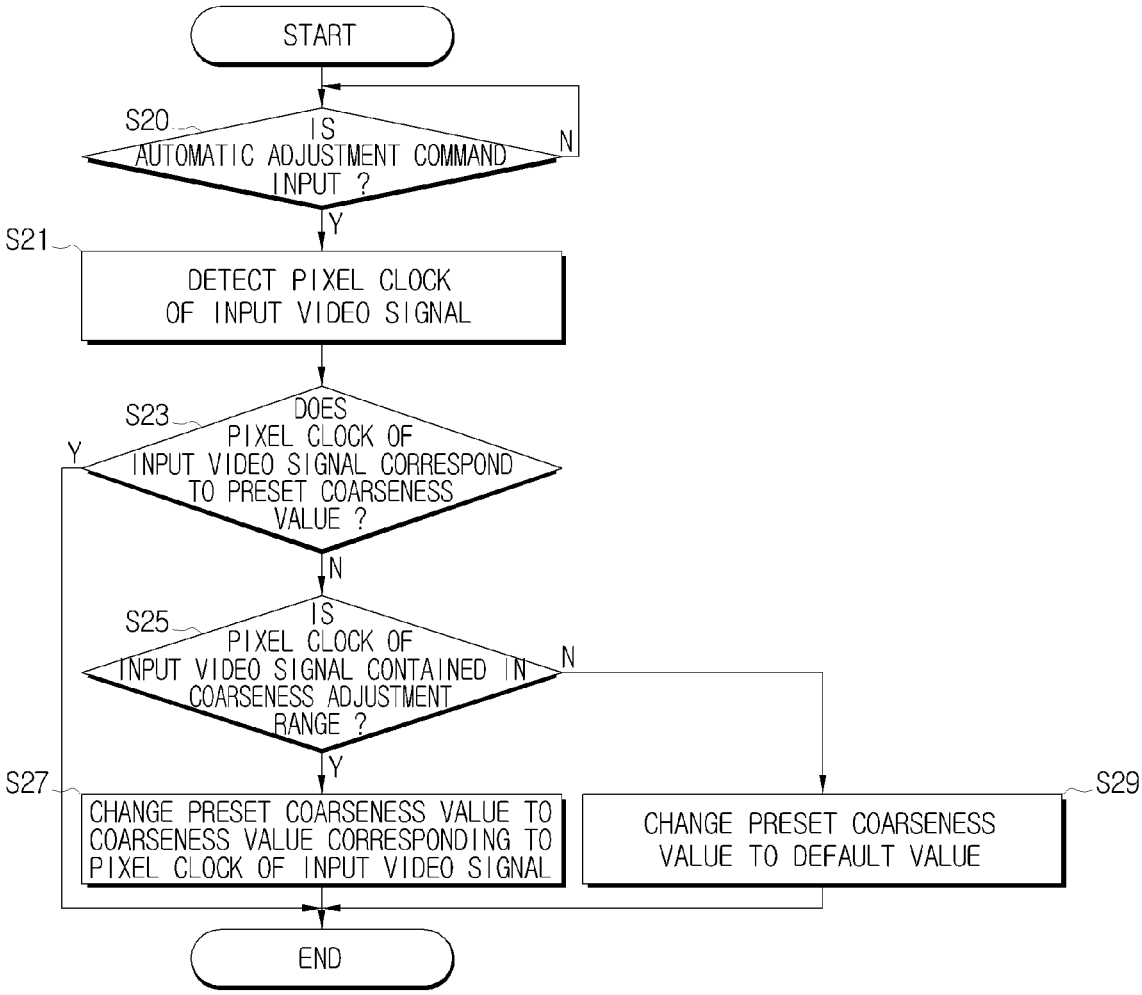
FIG. 3 (RELATED ART)
FIG. 3 is a flowchart explaining an automatic coarseness setting method in a related video display apparatus.

Certain exemplary embodiments of the present invention will now be described in greater detail with reference to the accompanying drawings.

In the following description, same drawing reference numerals refer to like elements throughout the drawings. The matters defined in the description, such as detailed construction and elements, are provided to assist in a comprehensive understanding of the invention. Thus, it is apparent that the exemplary embodiments of the present invention can be carried out without those specifically defined matters. Also, well-known functions or constructions are not described in detail since they would obscure the invention with unnecessary detail.

Figure 4:
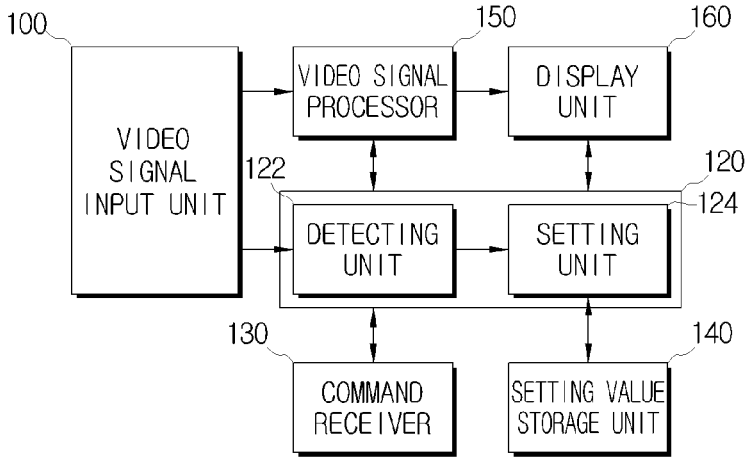
FIG. 4 is a block diagram schematically showing the configuration of a video display apparatus according to an exemplary embodiment of the present invention.

FIG. 4 is a block diagram schematically showing the configuration of a video display apparatus according to an exemplary embodiment of the present invention.

In FIG. 4, the video display apparatus according to an exemplary embodiment of the present invention comprises a video signal input unit 100, a controller 120, a command receiver 130, a setting value storage unit 140, a video signal processor 150 and a display unit 160.

The video signal input unit 100 receives an analog type video signal output from an external apparatus via a D-SUB connector. In other words, the video signal input unit 100 receives an analog RGB video signal, H Sync and V Sync values, and transfers the received signals to the video signal processor 150 and the controller 120.

The command receiver 130 comprises keys to receive various commands from a user. The command receiver 130 receives user commands input via a remote controller (not shown) and transfers the received command to the controller 120.

The setting value storage unit 140 stores default values, minimum values and maximum values in coarseness adjustment ranges. For example, if a first coarseness adjustment range indicates a mode to set a coarseness value of an input video signal applied with normal timing, the default value, minimum value and maximum value may be set to 2240, 2160 and 2320, respectively, and may be stored in the setting value storage unit 140. If a second coarseness adjustment range indicates a mode to set a coarseness value of an input video signal applied with offset timing, the default value, minimum value and maximum value may be set to 1840, 1760 and 1920, respectively, and may be stored in the setting value storage unit 140. It is impossible for a user to change the above values, and these values may be preserved even after the power source is turned off.

The setting value storage unit 140 also stores a coarseness value, which is manually set by a user, and the coarseness value set by the user may be one of the coarseness values contained in each coarseness adjustment range. The coarseness value set by the user may be stored without alteration until the user changes the coarseness value, and may be retained in the setting value storage unit 140 even after the power source is turned off The controller 120 controls the operation of the video display apparatus according to the user command input through the command receiver 130. The controller 120 comprises a detecting unit 122 and a setting unit 124.

The detecting unit 122 receives the H Sync and V Sync values among the video signals input through the video signal input unit 100, detects a pixel clock of the input video signal, and outputs the detected pixel clock to the setting unit 124.

The setting unit 124 automatically sets a coarseness value of the video display apparatus using the pixel clock output from the detecting unit 122. Specifically, the setting unit 124 selects a coarseness value most suitable for displaying the input video signal on a screen, from among the coarseness values contained in the coarseness adjustment ranges stored in the setting value storage unit 140. The operations of the setting unit 124 will be described in detail with reference to FIGS. 5 and 6.

The video signal processor 150 amplifies the analog RGB video signal input by the video signal input unit 100, and converts the analog video signal into a digital video signal by varying the level of the amplified signal, under the control of the controller 120. The display unit 160 displays the converted digital video signal and an on-screen-display (OSD) required for a user to control the video display apparatus on a screen under the control of the controller 120.

Figure 5:
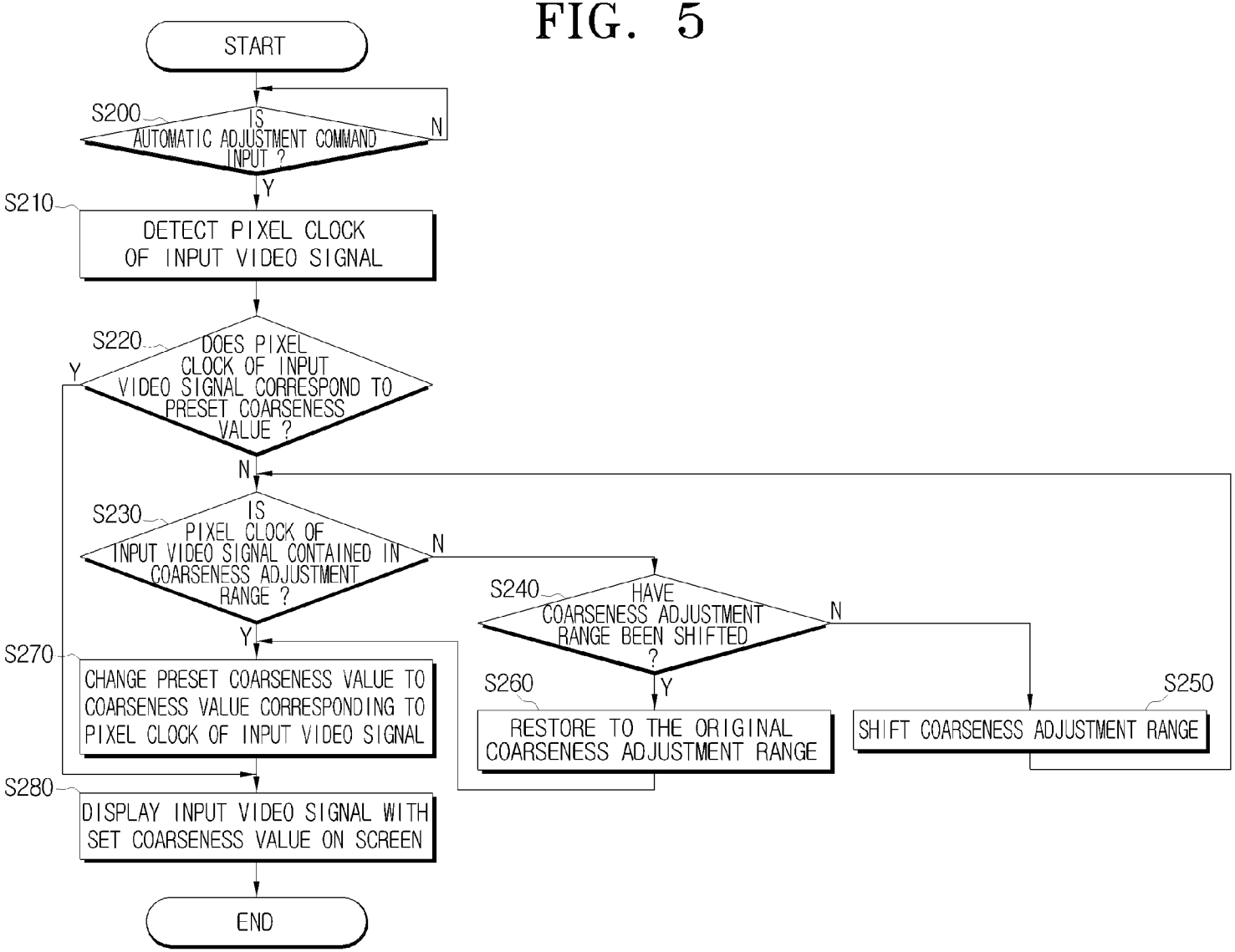
FIG. 5 is a flowchart illustrating an automatic coarseness setting method in a video display apparatus according to an exemplary embodiment of the present invention.

FIG. 5 is a flowchart illustrating an automatic coarseness setting method in a video display apparatus according to an exemplary embodiment of the present invention.

In FIG. 5, if an automatic adjustment command is input through the command receiver 130 (S200), the detecting unit 122 may detect a pixel clock of the input video signal (S210), and the setting unit 124 may determine whether the pixel clock of the input video signal corresponds to a preset coarseness value (S220).

If it is determined that the pixel clock of the input video signal corresponds to the preset coarseness value in operation S220, the input video signal may be displayed on the screen using the preset coarseness value (S280). In other words, the controller 120 controls the video signal processor 150 and the display unit 160 to display the input video signal on the screen using the preset coarseness value.

If it is determined that the pixel clock of the input video signal differs from the preset coarseness value in operation S220, the setting unit 124 may determine whether the pixel clock of the input video signal is contained in the selected coarseness adjustment range (S230). If it is determined that the pixel clock of the input video signal is contained in the coarseness adjustment range, the setting unit 124 may change the preset coarseness value to a coarseness value corresponding to the pixel clock of the input video signal (S270), and operation S280 may then be performed.

If it is determined that the pixel clock of the input video signal is not contained in the coarseness adjustment range in operation S230, the setting unit 124 may determine whether the selected coarseness adjustment range has been shifted (S240). If it is determined that the coarseness adjustment range has not been shifted, the setting unit 124 may shift the selected coarseness adjustment range (S250), and operation S230 may then be performed.

If it is determined that the selected coarseness adjustment range has been shifted during operation S240, the setting unit 124 may restore the selected coarseness adjustment range to its original range (S260), and operation S270 may then be performed. As described above, the automatic coarseness setting method is performed according to the automatic adjustment command, and may be described in detail using numerical values.

It is assumed that the default value, minimum value and maximum value are set to 2240, 2160 and 2320 in the first coarseness adjustment range, respectively, and the default value, minimum value and maximum value are set to 1840, 1760 and 1920 in the second coarseness adjustment range, respectively.

If a coarseness value is preset to 2270 in the video display apparatus, the coarseness value may be adjusted in the first coarseness adjustment range. In this situation, when a video signal with a pixel clock of 1900 is input, the pixel clock of the input video signal differs from the preset coarseness value, and thus the coarseness adjustment range may be shifted to the second coarseness adjustment range.

The pixel clock of 1900 for the input video signal is contained in the second coarseness adjustment range of from 1760 to 1920, so the preset coarseness value may be changed from 2270 to 1900, so that the input video signal may be displayed on the screen using a coarseness value of 1900.

If a coarseness value is preset to 1900 in the video display apparatus, the coarseness value may be adjusted in the second coarseness adjustment range. In this situation, if a video signal with a pixel clock of 2270 is input, the pixel clock of the input video signal may differ from the preset coarseness value, and may not be contained in the second coarseness adjustment range. Accordingly, the coarseness adjustment range may be shifted to the first coarseness adjustment range.

The pixel clock of 2150 for the input video signal is not contained in the first coarseness adjustment range of from 2160 to 2320, so the preset coarseness value may be changed from 1900 to 2270, so that the input video signal may be displayed on the screen using a coarseness value of 2270.

Figure 6:
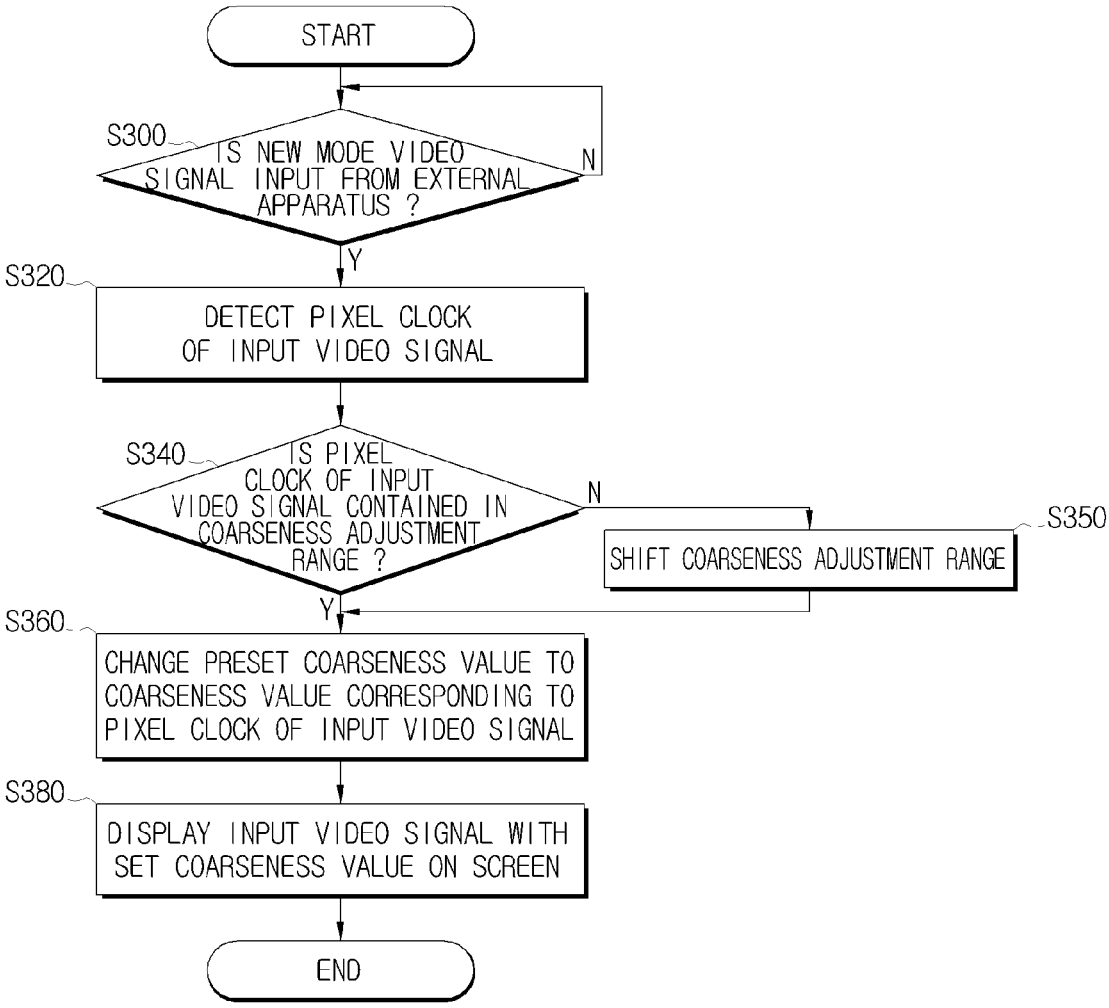
FIG. 6 is a flowchart illustrating an automatic coarseness setting method in a video display apparatus according to another exemplary embodiment of the present invention.

FIG. 6 is a flowchart illustrating an automatic coarseness setting method in a video display apparatus according to another exemplary embodiment of the present invention.

In FIG. 6, if a new mode video signal is input from an external apparatus (S300), that is, if a resolution of the video signal input by the video signal input unit 100 is changed, or if a video signal is input from another external apparatus, the detecting unit 122 may detect a pixel clock of the input video signal (S320). The setting unit 124 may determine whether the pixel clock of the input video signal is contained in the selected coarseness adjustment range (S340).

During operation S340, if it is determined that the pixel clock of the input video signal is contained in the selected coarseness adjustment range, the setting unit 124 may change the preset coarseness value to a coarseness value corresponding to the pixel clock of the input video signal (S360). The controller 120 controls the video signal processor 150 and the display unit 160 to display the input video signal on the screen using the preset coarseness value (S380).

During operation S340, if it is determined that the pixel clock of the input video signal is not contained in the selected coarseness adjustment range, the setting unit 124 may shift the selected coarseness adjustment range (S350), and operations S360 and S380 may then be performed.

Accordingly, if a new mode video signal is input, the automatic coarseness setting process may be performed as described above.

Figure 7:
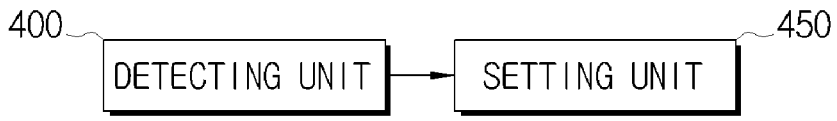
FIG. 7 is a block diagram schematically showing the configuration of a video display apparatus according to another exemplary embodiment of the present invention.

FIG. 7 is a block diagram schematically showing the configuration of a video display apparatus according to another exemplary embodiment of the present invention.

In FIG. 7, the video display apparatus according to the other exemplary embodiment of the present invention comprises a detecting unit 400 and a setting unit 450.

The detecting unit 400 receives H Sync and V Sync values of a video signal input from an external apparatus, and detects a pixel clock of the input video signal.

The setting unit 450 automatically sets a coarseness value of the video display apparatus using the pixel clock detected by the detecting unit 400. Specifically, the setting unit 450 selects one of a plurality of coarseness ranges, and sets one value from among coarseness values within the selected coarseness range as a coarseness value to be used to display the input video signal on the screen, based on the pixel clock of the input video signal.

Figure 8:
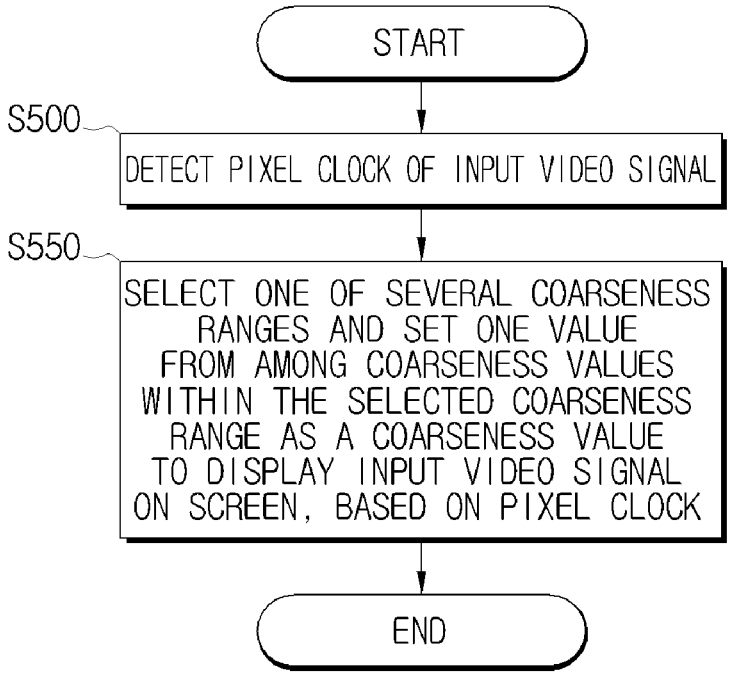
FIG. 8 is a flowchart illustrating an automatic coarseness setting method in a video display apparatus according to another exemplary embodiment of the present invention.

FIG. 8 is a flowchart illustrating an automatic coarseness setting method in a video display apparatus according to another exemplary embodiment of the present invention.

In FIG. 8, the detecting unit 400 detects the pixel clock of the input video signal (S500).

The setting unit 450 selects one of a plurality of coarseness ranges and sets one value from among coarseness values within the selected coarseness range as a coarseness value to be used to display the input video signal on the screen, based on the pixel clock of the input video signal (S550).

Although the coarseness values are used in the exemplary embodiments of the present invention, the present invention is applicable to elements which determine the video display environment or the video display characteristics instead of the coarseness values.

As described above, according to the exemplary embodiments of the present invention, a coarseness value is automatically set by shifting a coarseness adjustment range, and thus it is possible to provide optimum video display even when an input video signal is not in compliance with the VESA standard.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An automatic coarseness setting method comprising:

detecting a pixel clock of an input video signal;

selecting one of a plurality of coarseness ranges and setting one value from among a plurality of coarseness values within the selected coarseness range as a coarseness value for displaying the input video signal on a screen, based on the pixel clock;

determining whether the pixel clock of the input video signal is included in the selected coarseness range;

if it is determined that the pixel clock is included in the selected coarseness range, changing a preset coarseness value to the set one value corresponding to the pixel clock, which sets the coarseness range as the selected one of the plurality of coarseness ranges;

if it is determined that the pixel clock is not included in the selected coarseness range, determining whether the selected coarseness range has been shifted;

if it is determined that the selected coarseness range has been shifted, restoring the selected coarseness range to an original coarseness range; and if it is determined that the selected coarseness range has not been shifted, shifting the selected coarseness range to another one of the plurality of coarseness ranges and changing the set coarseness value to a value of the pixel clock of the input video signal.

2. The automatic coarseness setting method as claimed in claim 1, wherein each coarseness range of the plurality of coarseness ranges has a minimum coarseness value and a maximum coarseness value.

3. A video display apparatus comprising:

a detecting unit which detects a pixel clock of an input video signal; and a setting unit which selects one of a plurality of coarseness ranges and sets one value from among a plurality of coarseness values within the selected coarseness range as a coarseness value for displaying the input video signal on the screen, based on the pixel clock, wherein the setting unit determines whether the pixel clock of the input video signal is included in the selected coarseness range, if the setting unit determines that the pixel clock is included in the selected coarseness range, the setting unit changes a preset coarseness value to the set one value corresponding to the pixel clock, which sets the coarseness range as the selected one of the plurality of coarseness ranges, if the setting unit determines that the pixel clock is not included in the selected coarseness range, the setting unit determines whether the selected coarseness range has been shifted, if the setting unit determines that the selected coarseness range has been shifted, the setting unit restores the selected coarseness range to an original coarseness range, and if the setting unit determines that the pixel clock is not included in the selected coarseness range, the setting unit shifts the selected coarseness range to another one of the plurality of coarseness ranges and changes the set coarseness value to a value of the pixel clock of the input video signal.

4. The video display apparatus as claimed in claim 3, wherein each coarseness range of the plurality of coarseness ranges has a minimum coarseness value and a maximum coarseness value.

* * * * *